US006036270A

United States Patent [19]

Bufalini

[11] Patent Number: 6,036,270

[45] Date of Patent: Mar. 14, 2000

[54] COLLAPSIBLE CHAIR

[75] Inventor: Ivo Bufalini, Siena, Italy

[73] Assignee: Susana Hayman-Chaffey, Italy

[21] Appl. No.: 09/160,537

[22] Filed: Sep. 25, 1998

[30] Foreign Application Priority Data

May 8, 1998 [IT] Italy ..... AR98U0012 U

[51] Int. Cl.[7] ..... E03B 9/02

[52] U.S. Cl. ..... 297/440.15; 297/440.1

[58] Field of Search ..... 297/440.1, 440.13, 297/440.15, 440.23, 440.14

[56] References Cited

U.S. PATENT DOCUMENTS

| | | |
|---|---|---|
| D. 58,118 | 7/1921 | Townsend . |
| D. 248,709 | 8/1978 | Lundgren . |
| D. 252,602 | 8/1979 | Cirrone . |
| 2,036,157 | 3/1936 | Mansberger . |
| 2,551,071 | 5/1951 | Tyng . |
| 3,460,866 | 8/1969 | Kessel . |
| 3,527,497 | 9/1970 | Self . |
| 3,788,700 | 1/1974 | Wartes . |
| 4,140,065 | 2/1979 | Chacon . |
| 4,225,180 | 9/1980 | Gillis . |
| 5,454,331 | 10/1995 | Green . |
| 5,690,379 | 11/1997 | Cayssials . |
| 5,803,548 | 9/1998 | Battle . |

FOREIGN PATENT DOCUMENTS

| | | |
|---|---|---|
| 2151473 | 7/1985 | United Kingdom . |

*Primary Examiner*—Milton Nelson, Jr.
*Attorney, Agent, or Firm*—Rader, Fishman & Grauer; Ronald P. Kananen

[57] ABSTRACT

A collapsible chair for easy storage or transportation may be formed of four separate members including a seat member, two side members and a back member. Slip joints between the various members, which consist of slots through which portions of the other members extend, allow the four members to be assembled into a chair. Locking pins are inserted into those portions of the seat member which extend through the back and side members. The members of the chair can be flat for easy storage when disassembled or contoured for increased comfort. Addtionally, the members of the chair may be endowed with any variety of aesthetic elements.

4 Claims, 1 Drawing Sheet

COLLAPSIBLE CHAIR

FIELD OF THE INVENTION

The present invention relates to the field of transportable and occasional-use furniture, especially chairs. More particularly, the present invention relates to a collapsible chair and a method of making the same.

BACKGROUND OF THE INVENTION

Frequently, when someone is visited by friends or family the temporary need arises for additional seating for those visitors. Additionally, when one travels to, for example, the beach or an outdoor event, the need arises for seating which can be easily transported to such a destination. Consequently, collapsible chairs have been developed which are readily stored until needed or are easily transported to where they are needed.

Variously shaped collapsible chairs are known in the art. Most feature a folding supporting structure which facilitates the transportation and storage of the chair. However, the chairs with a folding support are generally bulky and structurally complex.

Specifically, conventional folding chairs are provided with mechanisms composed of joints that allow reciprocal rotations of the various parts to collapse the chair structure to a minimal size. With the passage of time, such joints tend to stiffen and/or rust, until their movement, and therefore the use of the chair, becomes difficult.

Additionally, conventional collapsible chairs are normally not very comfortable. Moreover, they are difficult to endow with aesthetic variations to satisfy buyers with different tastes. The cost of conventional collapsible chairs can also be high.

Consequently, there is a need in the art for a collapsible chair and a method of making the same which overcomes the above-mentioned difficulties. Specifically, there is a need in the art for a collapsible chair which does not involve a complex mechanism, which is comfortable and which can be provided with pleasing aesthetic qualities.

SUMMARY OF THE INVENTION

Consequently, it is an object of the present invention to meet the above-described needs and others. Specifically, it is a principal object of the present invention to provide a collapsible chair composed of several components which are relatively thin and do not involve a complex and expensive mechanism which gradually looses its functionality over time. Moreover, it is an object of the present invention to provide a collapsible chair which is capable of being readily disassembled and reassembled, even by people of limited technical ability.

Additionally, it is an object of the present invention to provide a collapsible chair which is comfortable, which is adapted for use both indoors and outdoors, and which is not readily subject to damage by environmental agents. It is a further object of the present invention to provide a collapsible chair which, when disassembled, is minimal is size and, therefore, easily transported and stored.

Finally, it is an object of the present invention to provide a collapsible chair which is can be endowed with a wide variety of aesthetic elements so as to appeal to the tastes of many different purchasers. Additional objects, advantages and novel features of the invention will be set forth in the description which follows or may be learned by those skilled in the art through reading these materials or practicing the invention. The objects and advantages of the invention may be achieved through the means recited in the attached claims.

To achieve the stated and other objects, the present invention may be embodied and described as a collapsible chair composed of four distinct members: a seat member; two side members; and a back member. The seat, side and back members are releasably engaged with each other to form the chair.

Preferably, the seat, side and back members are releasably engaged by a plurality of slip joints formed between the members. The slip joints are formed with slots provided in the various members of the chair. For example, the back member preferably has therein two vertical slots and one horizontal slot; while the side members each have one horiztonal slot. Then, when the chair is assembled, portions of the seat member extend through all of the horiztonal slots, and a portion of each of the side members extends respectively through one of the vertical slots in the back member.

Each of the portions of the seat member which extend through the horizontal slots preferably have a securing means disposed thereon for securing the seat member to the back and side members, respectively. In the preferred embodiment, the securing means includes a hole formed in each of the portions of the seat member which extend through the horizontal slots; and a locking pin which is inserted in the hole. The locking pins have an L-shape which allows them to be readily grasped for insertion or removal.

In the preferred embodiment, each of the side and back members has an oval shape, and the seat member has a round shape. Each of the side, back and seat members is flat for easy storage when disassembled. Alternatively, the members may be contoured to comfortably fit a human body.

The present invention also encompasses a method of assembling the collapsible chair described above by releasably engaging the seat, side and back members with each other to form the chair. The step of releasably engaging the four members preferably includes releasably engaging the back member with each of the two side members with slip joints; and releasably engaging the seat member with the back member and each of the two side members with slip joints.

When, as described above, the back member has therein two vertical slots and one horizontal slot, and the side members each have one horizontal slot formed therein, the method further includes inserting portions of the seat member in all of the horiztonal slots. This can be done by hand without the need for any tools or great mechanical ability.

When so inserted, a portion of the seat member may extend through each of the horizontal slots and has a securing means disposed thereon. The method of the present invention then includes securing the seat member to the back and side members, respectively, with the securing means. As described above, use of the securing means preferably includes inserting locking pins in holes formed in each of the portions of the seat member which extend through the horizontal slots.

BRIEF DESCRIPTION OF THE DRAWINGS

The accompanying drawings illustrate the present invention and are a part of the specification. Together with the following description, the drawings demonstrate and explain the principles of the present invention.

In the drawings.

Figure 1:
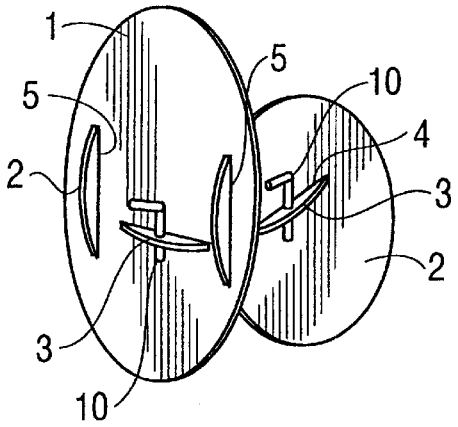
FIG. 1 is an illustration of a collapsible chair according to the principles of the present invention as viewed from a rear lateral position.

The collapsible chairs illustrated in the drawings are intended only as exemplary embodiments of the principles of the present invention, and are not intended to limit the scope of the invention to the particular examples illustrated. The scope of the present invention is defined by the appended claims.

DETAILED DESCRIPTION OF THE PREFERRED EMBODIMENTS

Using the drawings, the preferred embodiments of the present invention will now be explained in detail.

The present invention may be embodied in a chair which consists of four components made out of a durable material, for example, plastic or wood. One of the four members acts as a horizontal support, or the seat portion of the chair. The other three members are vertical supports and act the two side pieces and the seat back portion of the chair.

The three vertical support members are all provided with slots which couple with the horizontal support member, forming slip joints between the various members. The four members are thus interconnected to form a chair according to the principles of the present invention. The connections between the four members of the chair are stabilized by locking pins.

According to the present invention, the disassembly of the chair requires only the extraction of the locking pins and the ordered unthreading of the four components coupled by slip joint to one another. Therefore, disassembly of the chair is extremely simple and requires no tools.

In a first embodiment, the four components of the chair are each flat and can, therefore, be easily stacked for storage or transportation. Alternatively, the various components of the chair may be shaped and molded to any of an infinite variety of forms in order to give desired aesthetic qualities to the collapsible chair of the present invention. Additionally, the various components of the chair may also be curved to fit the contours of the human body, thereby making the chair much more comfortable than conventional folding chairs.

Referring now to the figures, particular examples of a collapsible chair according to the present invention will be explained. As shown in FIG. 1, a chair according to the present invention includes four cooperating members. A seat member 3 forms the seat of the chair as will be explained. Two side members 2, only one of which is visible in FIG. 1, form the sides of the chair. A back member 1 forms the back of the chair.

As shown in FIG. 1, the back member 1 includes two vertical slots 5. A portion of each of the two side members 2 is inserted into and extends through the vertical slots 5, respectively.

The back member 1 and the two side members 2 each include a single, horizontal slot 4. The three horizontal slots 4 are coplanar. A portion of the seat member 3 is inserted into and extends through the horizontal slots 4 in each of the back member 1 and two side members 2. Each of those portions of the seat member 3 which extend through the horizontal slots 4 in the back member 1 or side members 2 includes a hole.

As illustrated in FIG. 1, a locking pin 10 is inserted in each of these three holes. Preferably, the locking pin has an L-shape as shown in FIG. 1. The L-shape provides a vertical leg which can be inserted in the hole in the seat member 3, and a horizontal leg which both acts as a handle for grasping and removing the locking pin, and abuts the seat member 3 to prevent the locking pin 10 from passing entirely through the hole in the seat member. As will be appreciated by those of skill in the art, the locking pins 10 could be equivalently replaced by other fastening means, including but not limited to, screws, bolts, wing nuts, cotter pins, etc.

With the three locking pins 10 inserted in each of the three holes in the seat member 3, the collapsible chair of the present invention is assembled and ready for use. The pins secure the four members 1, 2 and 3 together into a chair structure.

As illustrated in FIG. 1, the four members 1, 2 and 3 of the chair have a rounded or oval shape which allows the necessary slip joints to be formed by inserting the rounded edges of the four members in the various slots as shown in FIG. 1. Preferably, the components of the invention are constructed of a mechanically durable material such as metal, wood or heavy plastic with the aim of supporting the stresses deriving from the weight of a seated person.

Figure 2:
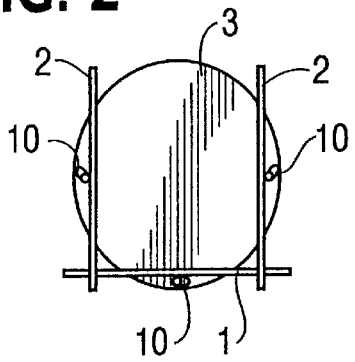
FIG. 2 is a plane view of a collapsible chair of the present invention.

FIG. 2 shows a view of the collapsible chair of FIG. 1 as seen from above. The seat member 3 has a substantially round shape, the edges of which are inserted in the coplanar slots of the side members 2 and back member 1 to form slip joints.

The seat member 3 is secured in the three slip joints by locking pins 10.

Figure 3:
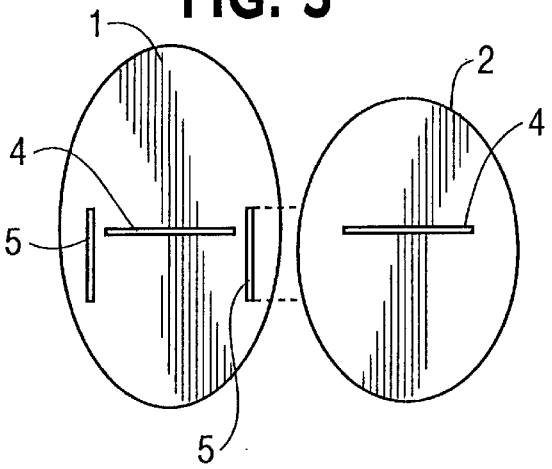
FIG. 3 is a frontal view of a seat back component and a side component of collapsible chair of the present invention.

FIG. 3 shows a view of the back member 1, with vertical slots 5 and horizontal slot 4, and a side member 2 with a horizontal slot 4. As indicated in FIG. 3, the rounded edge of the side member 2 is inserted through one of the vertical slots 5 of the back member 1.

As mentioned above, the present invention is not restricted to any particular shapes for the four cooperating members. The four members 1, 2 and 3 may assume any number of shapes and contours to provide ergonomic qualities and aesthetic features to the collapsible chair of the present invention.

Figure 4:
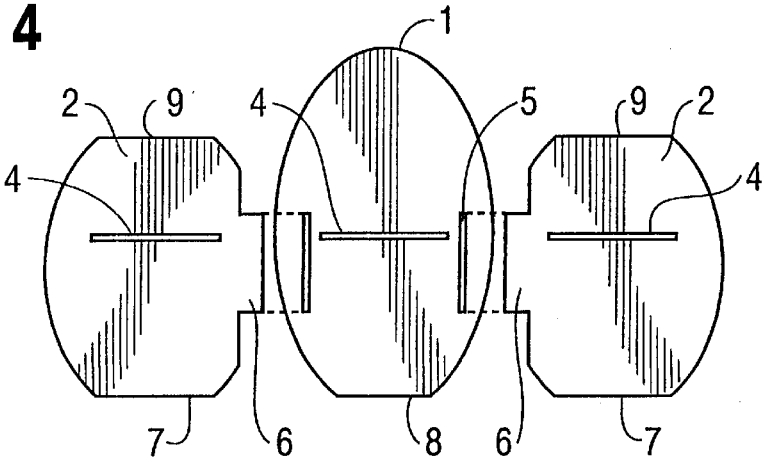
FIG. 4 is a frontal view of the seat back component and of two side components of a collapsible chair according to the present invention in a different aesthetic configuration.

For example, a second embodiment of the present invention is illustrated in FIG. 4. As shown in FIG. 4, the side members 2 no longer have an oval shape, rather, the top of the oval shape is truncated to form a horizontal edge 9 which can serve as an armrest in the assembled chair. Furthermore, the bottoms of the side members 2 and the back member 1 are also truncated to provide horizontal edges 7 and 8 respectively. These horizontal edges 7 and 8 may provide a more stable chair by causing more of the bottom edges of the chair to engage the floor.

The sides members 2 of the chair illustrated in FIG. 4 also have tab portions 6 which are sized and positioned to extend into the vertical slots 5 of the back member for forming the requisite slip joints with the back member 1. Thus, any number of aesthetic and ergonomic configurations may be implemented by those skilled in the art within the spirit and scope of the present invention.

The preceding description has been presented only to illustrate and describe the invention. It is not intended to be exhaustive or to limit the invention to any precise form disclosed. Many modifications and variations are possible in light of the above teaching.

The preferred embodiment was chosen and described in order to best explain the principles of the invention and its practical application. The preceding description is intended to enable others skilled in the art to best utilize the invention in various embodiments and with various modifications as are suited to the particular use contemplated. It is intended that the scope of the invention be defined by the following claims.

What is claimed is:

1. A collapsible chair, comprising:

a seat member;

two side members each having at least one substantially parabolic curved edge; and a back member;

wherein said seat, side and back members are releasably engaged to form said chair;

wherein at least one parabolic curved edge of each of said two side members is inserted through a respective slot in said back member so as to be releasably engaged therewith;

wherein said back member further has one horizontal slot formed therein; said side members each have one horizontal slot formed therein; and portions of said seat member extend through all of said horizontal slots when said chair is assembled;

wherein each of said portions of said seat member which extend through said horizontal slots have a securing means disposed thereon for securing said seat member to said back and side members, respectively;

wherein each of said securing means comprises a hole formed in each of said portions of said seat member which extend through said horizontal slots; and a locking pin which is inserted in said hole; and wherein said locking pins have an L-shape.

2. A chair as claimed in claim 1, wherein each of said side and back members is an oval, and said seat member is round.

3. A chair as claimed in claim 1, wherein each of said side, back and seat members is flat.

4. A collapsible chair, comprising:

a seat member having at least one substantially parabolic curved edge;

two side members; and a back member;

wherein said seat, side and back members are releasably engaged to form said chair;

wherein at least one parabolic curved edge of said seat member is inserted through respective horizontal slots in said back and side member;

wherein each of said edges of said seat member which extend through said horizontal slots have a securing means disposed thereon for securing said seat member to said back and side members, respectively;

wherein each of said securing means comprises a hole formed in each of said edges of said seat member which extend through said horizontal slots; and a locking pin which is inserted in said hole; and wherein said locking pins have an L-shape.

* * * * *